US005779206A

United States Patent [19]

Harris et al.

[11] Patent Number: 5,779,206

[45] Date of Patent: Jul. 14, 1998

[54] HANGER ASSEMBLY

[75] Inventors: David C. Harris, Baraboo, Wis.; William T. DeBruyn, Rockford, Ill.

[73] Assignee: Sterling Plastics Co., Madison, Wis.

[21] Appl. No.: 556,625

[22] Filed: Nov. 13, 1995

[51] Int. Cl.[6] ..... A47B 96/06

[52] U.S. Cl. ..... 248/214; 248/298.1

[58] Field of Search ..... 248/214, 685, 248/288.11, 298.1, 231.41, 231.61, 223.21, 224.51, 224.61, 222.13, 225.11, 242.2, 215

[56] References Cited

U.S. PATENT DOCUMENTS

| | | | |
|---|---|---|---|
| 2,677,585 | 5/1954 | La Voy . | |
| 2,955,794 | 10/1960 | Robbins | 248/215 |
| 3,029,465 | 4/1962 | Graber et al. | 248/298.1 |
| 3,037,639 | 6/1962 | Kost . | |
| 3,765,633 | 10/1973 | Caud, II | 248/229.12 |
| 3,847,286 | 11/1974 | Garrett . | |
| 3,907,118 | 9/1975 | Pelavin . | |
| 4,018,019 | 4/1977 | Raith et al. . | |
| 4,022,415 | 5/1977 | Roderick et al. | 248/298.1 |
| 4,685,255 | 8/1987 | Kelley . | |
| 4,821,477 | 4/1989 | Rydqvist . | |
| 4,901,871 | 2/1990 | Ohm et al. . | |
| 5,131,616 | 7/1992 | Biba | 248/298.1 |
| 5,370,246 | 12/1994 | Traynor . | |

OTHER PUBLICATIONS

Back cover of retail packaging for deflect–o® partition Brackets.

*Primary Examiner*—Leslie A. Braun
*Assistant Examiner*—Willie Berry, Jr.
*Attorney, Agent, or Firm*—Foley & Lardner

[57] ABSTRACT

An adjustable hanger assembly for hanging auxiliary office items in a modular office includes an "L" shape support bracket and an "L" shape attachment bracket. The support bracket includes a channel having a top plate with a slot provided with a plurality of detents located along the slot. The attachment bracket includes a resilient finger having a button provided with a pair of detents. The attachment bracket is releasably secured within the channel such that the button is located within the slot and the projections are selectively located within the detents by the resilient finger.

19 Claims, 3 Drawing Sheets

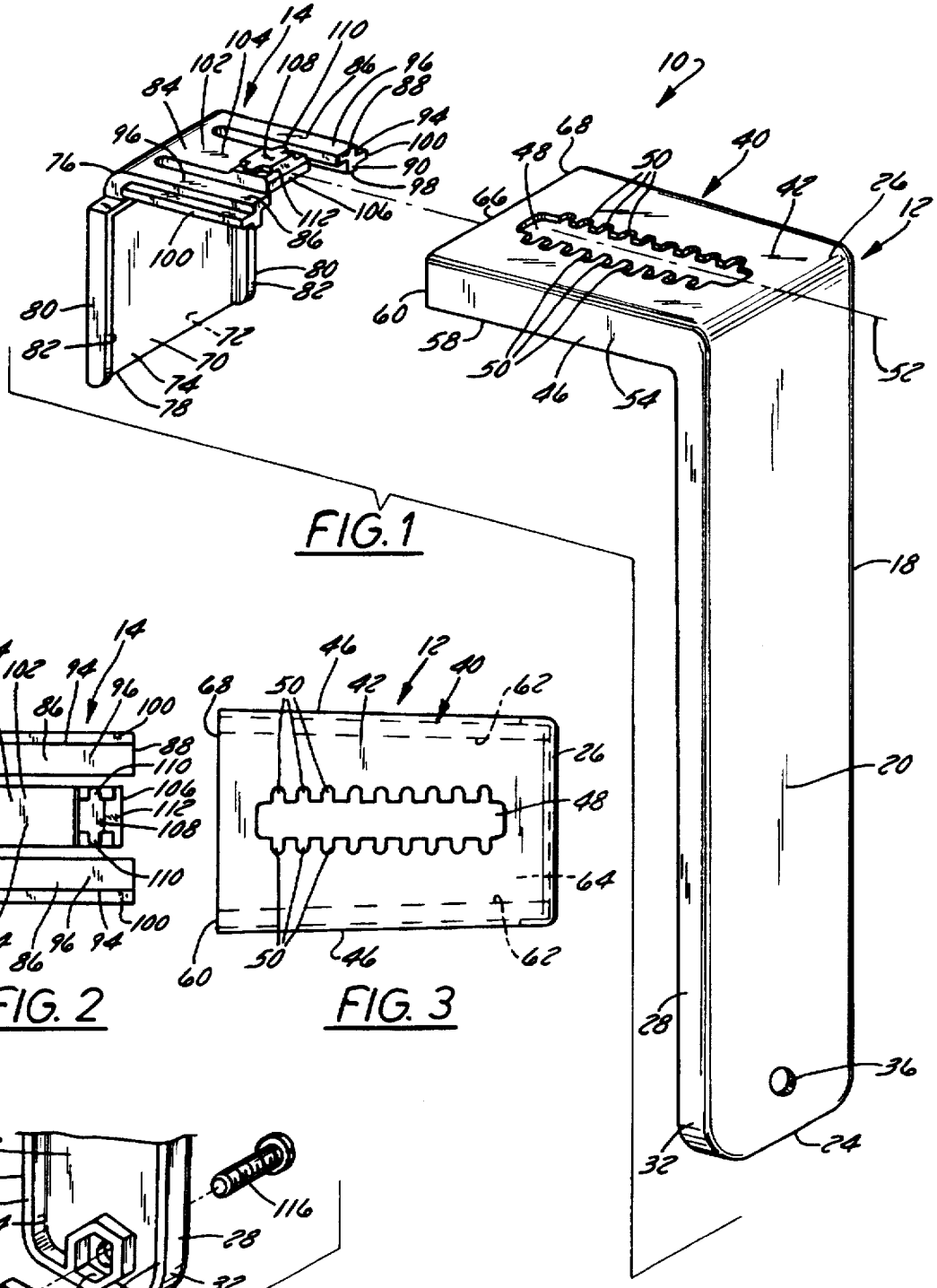
FIG. 1
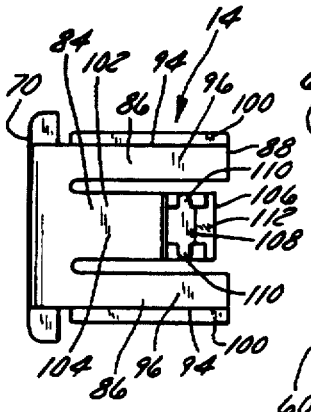
FIG. 2
FIG. 3
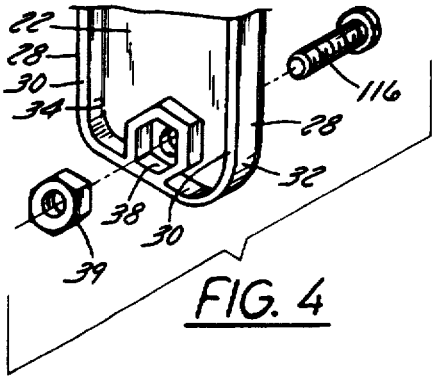
FIG. 4

HANGER ASSEMBLY

BACKGROUND OF THE INVENTION

1. Field of the Invention

The present invention relates generally to the field of hanger assemblies. More particularly, the invention relates to an adjustable partition hanger assembly for use with a variety of partitions or screens of varying thickness.

2. Description of Prior Art

Modular office space created by partition panels is becoming increasingly popular. In these modular offices, a number of partition panels are assembled forming discrete office work stations. It is often desirable to add amenities to the work stations once they are constructed. Unlike a structural wall in which bookshelves or file holders can be affixed, partition panels are often not constructed in a manner to support these auxiliary office products.

Attempts have been made to incorporate supports within the design of the partition panels to provide a mechanism by which an auxiliary office product could be suspended. These solutions however, require the auxiliary office products as well as the partitions to have special attaching components. For example, U.S. Pat. No. 4,821,477, issued April 1989 to Rydqvist, discloses the use of a groove located on the top edge of the partition for attachment of shelves, tops, cabinets or other pieces of office furniture. The office furniture is provided with a special attachment member that fits within the groove. This solution requires a unique attachment member for attachment to the partition.

An adjustable bracket for attachment over the top of a partition to suspend items has been marketed under the trademark DEFLECT-O. This device includes two "L" shaped bracket portions which are adjustably connected with a screw. One bracket portion has a hole and the second bracket portion has a slot. The two bracket portions are attached to one another by securing a nut and bolt through the slot and hole. In this manner the width of the bracket can be varied to fit a variety of partition widths. This device, however, requires the use of tools to construct the width of the bracket.

Accordingly, it would be desirable to have an adjustable bracket for attachment to a variety of partitions which may be easily adjusted and attached.

SUMMARY OF THE INVENTION

The present invention features a novel hanger assembly for attachment to a partition or a screen comprising a support bracket and an attachment bracket. The support bracket has a channel portion and an elongate member extending from and generally transversely to the channel portion. The channel portion has a channel and at least one detent. The attachment bracket is releasably attached to the support bracket. The attachment bracket includes a resilient finger having a catch that cooperates with the at least one detent when the support and attachment brackets are engaged.

In accordance with yet another aspect of the invention, the elongate member includes an aperture extending therethrough at a position spaced from the channel. The elongate member further includes a well adapted to prevent the rotation of a nut.

BRIEF DESCRIPTION OF THE DRAWINGS

These and other features of the invention will be more fully understood by reference to the following description and the appended FIGURES, wherein like reference numerals designate like elements and in which:

FIG. 1 is an exploded perspective view of the support member and attachment member of a hanger assembly in accordance with the present invention;

FIG. 2 is a top view of the attachment member of the hanger assembly of FIG. 1;

FIG. 3 is a top view of the support member of the hanger assembly of FIG. 1;

FIG. 4 is an exploded perspective view of bottom portion of the support member, bolt and attachment nut of the hanger assembly of FIG. 1;

DETAILED DESCRIPTION OF THE PREFERRED EMBODIMENTS

Figure 5:
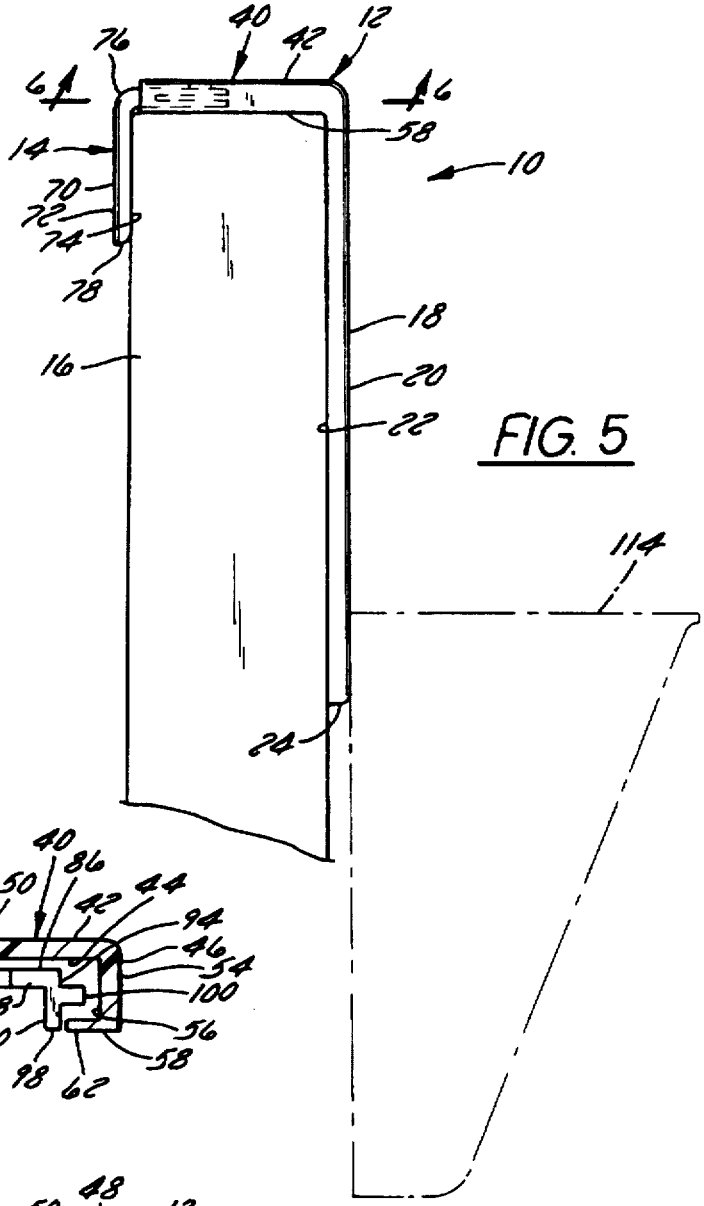
FIG. 5 is a side view of the hanger assembly of FIG. 1 attached to a partition screen.

Turning now to the drawings and referring first to FIGS. 1 and 5, a hanger assembly 10 comprises a support bracket 12 and an attachment bracket 14 configured to adjustably form a hanger for attachment to a partition or screen 16. Support bracket 12 includes an elongate member 18 having an outside surface 20, an inside surface 22, a bottom end 24 and a top end 26. Elongate member 18 further includes a pair of walls 28 extending from and generally transversely to inside surface 22. Each wall 28 includes a top edge 30, an outside surface 32 and an inside surface 34.

Support bracket 12 further includes an aperture 36 extending through elongate member 18. A well 38 configured to support a fastener, such as a nut 39, extends from inside surface 34 of elongate member 18 about aperture 36 as illustrated in FIGS. 1 and 4.

Figure 7:
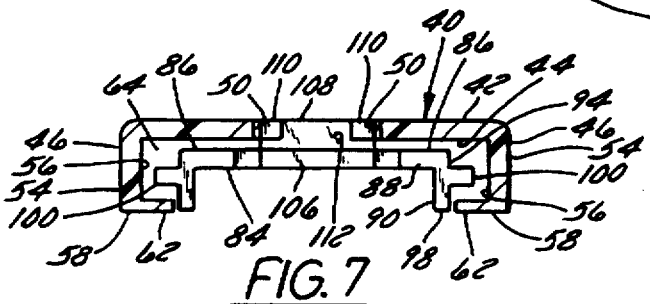
FIG. 7 is a cross-sectional view generally along line 7—7 of FIG. 6.

Referring to FIGS. 1, 3 and 7, support bracket 12 further includes a receptacle 40 integrally formed and extending normal to top end 26 of elongate member 18. Receptacle 40 includes a top surface 42, a bottom surface 44 and a pair of sidewalls 46 preferably extending normal to bottom surface 44. Top surface 42 includes a slot 48 extending longitudinally along receptacle 40. A plurality of detents 50 arranged in pairs about a longitudinal axis 52 are located along slot 48.

Each sidewall 46 includes an outside surface 54, an inside surface 56, a bottom edge 58 and a front end 60. Extending from inside surface 56, proximate bottom edge 58 of each side wall 46 is a channel flange 62. Receptacle 40 includes a channel 64 defined by bottom surface 44, sidewalls 46 and channel flanges 62. Channel 64 includes a channel opening 66 proximate front end 68 of receptacle 40.

Referring to FIGS. 1 and 2, attachment bracket 14 includes a side plate 70 having an outside surface 72, an inside surface 74, a top end 76 and a bottom end 78. Attachment bracket 14 further includes a pair of walls 80 integrally formed with side plate 70, preferably extending normal to inside surface 74. Walls 80 include an exposed edge 82 located distally from inside surface 74.

Attachment bracket 14 further includes a clip portion 84 having a pair of external fingers 86. Each external finger 86 has an "L" shaped form including a first leg 88 and a second leg 90 transverse to first leg 88. First leg 88 includes an outside edge 94 and a top surface 96 generally normal to side plate 70. Second leg 90 extends away from top surface 96 proximate outside edge 94. Second leg 90 includes a top edge integrally formed with first leg 88 and a second edge 98 located distally from the first edge. Each "L" shaped finger 86 has a guide flange 100 extending outwardly from second leg 90, intermediate first leg 88 and second edge 98.

Clip portion 84 further includes a resilient finger 102 located intermediate pair of external fingers 86. Resilient finger 102 includes a top surface 104 substantially parallel with top surface 96 of external fingers 86. Resilient finger 102 also includes a front end 106 which does not extend as far from side plate 70 as external fingers 86 (see FIG. 2). Resilient finger 102 is integrally formed with clip portion 84 at its rear end.

Resilient finger 102 further includes a button 108 extending from top surface 104. Button 108 includes a pair of projections 110 extending therefrom. Button 108 further includes a beveled surface 112 extending from a top of button 108 to front end 106 of resilient finger 102. In an alternative preferred embodiment resilient finger 102 includes a rib (not shown) extending from the bottom surface of the resilient finger. The rib provides increased rigidity and strength to the resilient finger.

Figure 6:
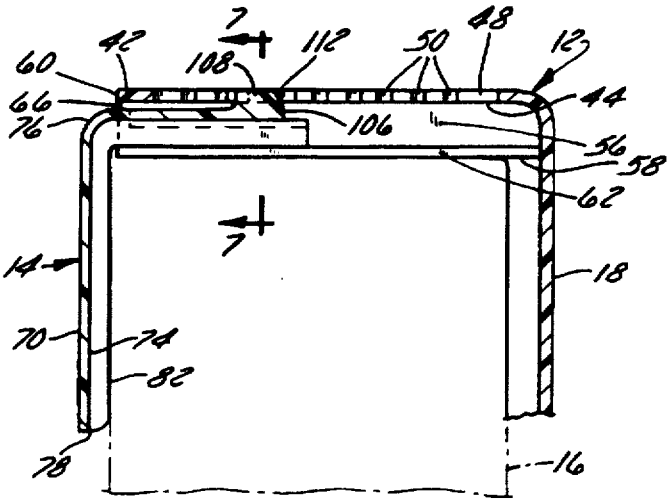
FIG. 6 is a cross sectional view taken generally along line 6—6 of FIG. 5.

Referring to FIGS. 5, 6 and 7, the assembly and operation of hanger assembly 10 will be described. Support bracket 12 is placed upon partition 16 such that side walls 28 of elongate member 18 are flush against the vertical wall of partition 16. Further, bottom edge 58 of sidewalls 46 of receptacle 40 are flush against the top edge of partition 16. Attachment bracket 14 is releasably attached to support bracket 12 by sliding clip portion 84 within channel 64 of support bracket 12. Guide flange 100 of clip portion 84 rides upon channel flanges 62 until beveled surface 112 of button 108 abuts front end 68 of receptacle 40. The application of force results in the depression of resilient finger 102 as attachment bracket enters channel 64. Once button 108 reaches slot 48 and detents 50, resilient finger 102 snaps back to its original position such that projections 110 are located within the first set of detents 50, proximate front end 68 of channel 64. In this position, top surface of button 108 is substantially flush with top surface 42 of receptacle 40.

The distance between the elongate member 18 and side plate 70 along axis 52 is adjusted by depressing button 108 away from top surface 42 of receptacle 40 such that projections 110 are released from detents 50. Note that when button 108 is depressed such that projections 110 are released from detents 50 the bottom of button 108 clears the top edge of partition 16. As described above, the width of the bracket assembly may be discretely adjusted based on the location of detents 50.

In an alternative embodiment, projections 110 also include a beveled surface thereby permitting continuous reduction of the overall width without the need to depress button 108. However, to increase the width of hanger assembly 10, button 108 would need to be depressed to release projections 110 from detents 50.

A file folder, shelf, envelope pocket 114 or other auxiliary office item may be attached to hanger assembly 10 by a fastener such as a bolt 116, threaded through nut 39 contained within well 38. Nut 39 is located adjacent inside surface 22 of elongate member 18 and is prohibited from rotating by well 38. Although a single hanger assembly 10 may be used to attach an item to a partition 16, a number of hanger assemblies 10 may be used together as well.

Figure 8:
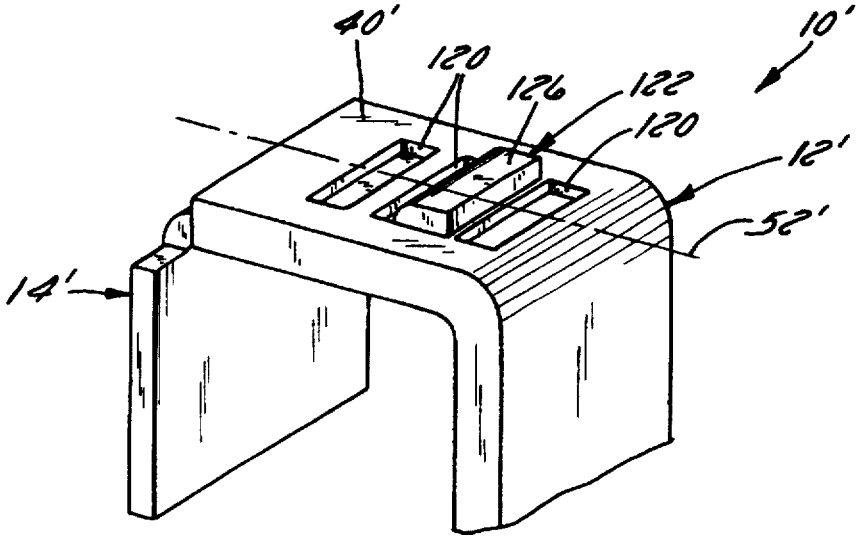
FIG. 8 is a perspective view of an alternative embodiment of a hanger assembly.
Figure 9:
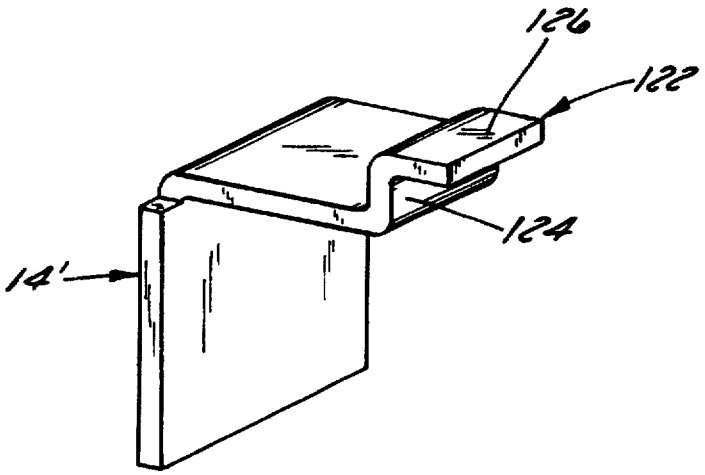
FIG. 9 is a perspective view of the attachment member of the hanger assembly of FIG. 8.

In another embodiment, receptacle 40' of support bracket 12' includes a plurality of spaced slots 120 transverse to longitudinal axis 52' (see FIG. 8). In this embodiment, attachment bracket 14' includes an attachment finger 122 having a base portion 124 extending from the top surface of the attachment bracket 14' and having an engagement portion 126 extending generally transverse to the base portion 124 and parallel to the top of the attachment bracket 14'. In this embodiment, the attachment finger 122 is selectively inserted into one of the plurality of spaced slots 120 to set the width of the hanger assembly 10'.

It will be understood that the foregoing description is of preferred exemplary embodiments of this invention and that the invention is not limited to the specific forms shown. For example, hanger assembly could utilize a side clip, in which support bracket 12 includes a pair of slots with detents located within sidewalls 46. Each sidewall 46 is configured to receive a button 108 from a resilient finger 102 which flexes in a direction normal to axis 52. Additionally, button 108 could extend above top surface 42 of receptacle 40 when the support and attachment brackets are in the engaged position. This would provide easier manipulation of the button 108. Also, guide flanges 100 could be located proximate bottom edge 98 of second leg 90. Further, aperture 36 can be replaced with a hook or other mechanical fastener. These and other modifications may be made in the design and arrangement of the elements without departing from the scope of the invention as expressed in the appended claims.

What is claimed is:

1. A hanger assembly for attachment to a partition or a screen, comprising:

a support bracket including a channel portion and an elongate member extending generally transversely from the channel portion, the channel portion having a channel and at least one detent; and an attachment bracket adjustably engaged with the channel, the attachment bracket including a resilient finger having a catch, the catch being releasably engaged within at least one detent by depression of the resilient finger.

2. The hanger assembly of claim 1, wherein the elongate member includes a means for attaching an item.

3. The hanger assembly of claim 2, wherein the means for attaching an item includes an aperture extending through the elongate member, the elongate member further including a well adapted to prevent the rotation of a nut.

4. The hanger assembly of claim 1, wherein the channel includes a top surface, a pair of side walls and a pair of channel flanges extending from the side walls.

5. The hanger assembly of claim 4, wherein the resilient finger is centrally located along a longitudinal axis.

6. The hanger assembly of claim 5, further comprising a slot situated along the longitudinal axis intermediate the pair of side walls.

7. The hanger assembly of claim 6, wherein the attachment member further includes a pair of external fingers, each external finger having a top end and a bottom end, wherein each guide flange is attached to one external finger intermediate the top end and bottom end.

8. The hanger assembly of claim 4, wherein the attachment bracket includes a pair of guide flanges for supporting the attachment bracket on the channel flanges, when the attachment bracket and support bracket are engaged.

9. The hanger assembly of claim 1, wherein the elongate member includes a pair of side walls extending therefrom.

10. An adjustable bracket for hanging an office item from a partition or screen, the adjustable hanger, comprising:

a first bracket having a first generally "L" shaped portion and including a channel adapted to releasably engage a second "L" shaped bracket having a second generally "L" shaped portion, the second bracket having a resilient member adapted to engage the first bracket and releasably hold the first bracket at a selected position with respect to the second bracket by depression of the resilient member.

11. The hanger assembly of claim 10, wherein one of the brackets includes an elongate member having an attachment region to which an item can be attached.

12. An adjustable bracket for hanging an office item from a partition or screen, the adjustable hanger, comprising:

a first bracket having a first generally "L" shaped portion and including a channel adapted to releasably engage a second "L" shaped bracket having a second generally "L" shaped portion, the second bracket having a resilient member adapted to engage the first bracket and hold the first bracket at a selected position with respect to the second bracket, wherein one of the brackets includes an elongate member having an attachment region to which an item can be attached, wherein the attachment region includes an aperture extending through the elongate member, the elongate member further including a well adapted to prevent the rotation of a nut.

13. The hanger assembly of claim 10, wherein the channel is defined by a top surface, a pair of side walls and a pair of channel flanges extending from the side walls.

14. An adjustable bracket for hanging an office item from a partition or screen, the adjustable hanger, comprising:

a first bracket having a first generally "L" shaped portion and including a channel adapted to releasably engage a second "L" shaped bracket having a second generally "L" shaped portion, the second bracket having a resilient member adapted to engage the first bracket and hold the first bracket at a selected position with respect to the second bracket, wherein the channel is defined by a top surface, a pair of side walls and a pair of channel flanges extending from the side walls, wherein a slot is situated along the top surface intermediate the pair of side walls, the slot including a plurality of detents.

15. The hanger assembly of claim 14, wherein the resilient member is centrally located along a longitudinal axis.

16. The hanger assembly of claim 15, wherein the resilient member includes a button having a projection, wherein the button fits within the slot and the projection fits within at least one detent when the support and attachment brackets are engaged.

17. A hanger assembly for attachment to a partition, comprising:

a support bracket having a plurality of spaced slots; and an attachment bracket having a top surface and an attachment finger having a base portion extending transverse to the top surface, the attachment finger having an engagement portion extending generally transverse to the base portion and generally parallel to the top surface;

wherein the attachment finger is selectively inserted into one of the plurality of spaced slots to selectively hold the support bracket at a selected position relative to the attachment bracket.

18. The hanger assembly of claim 17, wherein one of the support bracket and attachment bracket includes an attachment region to which an item can be attached.

19. An adjustable bracket for hanging an office item from a partition or screen, the adjustable bracket, comprising:

a first bracket having a first generally "L" shaped portion and a second bracket, the second bracket adapted to engage the first bracket and hold the first bracket at a selected position, wherein one of the brackets includes an elongate member having an attachment region to which an item can be attached, the attachment region including an aperture extending through the elongate member, the elongate member further including a well adapted to prevent the rotation of a nut.

* * * * *